US006163941A

United States Patent [19]

Lai

[11] Patent Number: 6,163,941

[45] Date of Patent: Dec. 26, 2000

[54] ADJUSTABLE BUCKLE DEVICE

[75] Inventor: Jefferson Lai, Taipei, Taiwan

[73] Assignee: Taiwan Industrial Fastener Corp., Taipei, Taiwan

[21] Appl. No.: 09/384,200

[22] Filed: Aug. 27, 1999

[30] Foreign Application Priority Data

Aug. 27, 1998 [TW] Taiwan ..... 87214092

[51] Int. Cl.[7] ..... A44B 11/00

[52] U.S. Cl. ..... 24/580; 24/68 R; 24/68 SK; 24/191

[58] Field of Search ..... 24/580–585, 170, 24/178, 171, 179, 191, 68 R, 68 E, 68 SK, 265 BC, 265 EC

[56] References Cited

U.S. PATENT DOCUMENTS

| | | | |
|---|---|---|---|
| Re. 35,418 | 1/1997 | Martignago | 24/68 SK |
| 4,999,846 | 3/1991 | Ball et al. | 24/191 X |
| 5,172,454 | 12/1992 | Martignago | 24/68 SK |
| 5,416,952 | 5/1995 | Dodge | 24/68 R |
| 5,575,045 | 11/1996 | Chu | 24/68 SK |
| 5,606,779 | 3/1997 | Lu | 24/68 SK |
| 5,779,259 | 7/1998 | Lin | 24/68 SK |
| 5,852,852 | 12/1998 | Rigal | 24/68 R |

*Primary Examiner*—Robert J. Sandy
*Attorney, Agent, or Firm*—Bacon & Thomas, PLLC

[57] ABSTRACT

An adjustable buckle device used in conjunction with a strap or the like for holding an object firmly in position is provided. The buckle device includes a buckle body fixed to one end of the strap and a ratchet member fixed to the other end of the strap for firmly releaseably engagement with the buckle body. The buckle body has a base and a locking plate pivotally coupled to the base for firmly engaging with the ratchet member. The locking plate is formed with a stopper for stopping the ratchet member from being released from the buckle body after the ratchet member enters and passes through the buckle body. The locking plate also allows the disengagement of the buckle body and the ratchet member to be conveniently operated by simply lifting up the locking plate.

7 Claims, 2 Drawing Sheets

ADJUSTABLE BUCKLE DEVICE

FIELD OF THE INVENTION

The present invention relates to buckle devices and, more particularly, to an adjustable buckle device used in connection with a strap or the like for buckling an object tightly in position.

DESCRIPTION OF THE PRIOR ART

Buckle devices are a contrivance that includes a male fastener fixed to one end of a flexible and rugged strap or the like and a female fastener fixed to the other end of the same for holding objects tightly in position by engaging the male fastener securely with the female fastener. Conventionally, the male fastener is engaged with the male fastener by means of locking a tongue-like member on the male fastener with a pivotable locking member on the female fastener. To engage, the tongue-like member on the male fastener is inserted into the female fastener, while the pivotable locking member is positioned in an unlocking state, and then the pivotable pivotable locking member is pressed down to a locking position where the pivotable locking member securely fastens and locks the tongue-like member in position in the female fastener, thereby fastening the male fastener securely to the female fastener. To disengage, the user can pull the pivotable locking member up so as to draw it away from the locking position and thus allow the tongue-like member not to be locked from the pivotable locking member. This allows male fastener to be disengaged from the female fastener.

On drawback to the foregoing buckling device, however, is that the engagement and disengagement of the male fastener and the female fastener both require the user to perform at least two steps of operation to achieve. To engage, the first step is to insert the tongue-like member into an insertion hole in the female fastener while the pivotable locking member is locked, and then the second step is to press down the pivotable locking member to forcibly lock the tongue-like member in position. To disengage, the first step is to pull up the pivotable locking member to unlock the tongue-like member, and then the second step is to pull the male fastener away from the female fastener by hand. The two-step engagement and disengagement will take much time and effort to complete. These exists, therefore, a need for a new buckling device which allows the engagement and disengagement of the male fastener and female fastener to be quickly done in just one step.

SUMMARY OF THE INVENTION

It is therefore a primary objective of the present invention to provide an adjustable buckle device which is simpler in structure and more convenient in operation than its prior art.

In accordance with the foregoing and other objectives of the present invention, an improved adjustable buckle device is provided. The adjustable buckle device include a buckle body fixed to one end of a flexible strap or the like and a ratchet member attached to the other end of the strap or the like for securely engagement with the buckle body.

The buckle body has a base with a generally U-shaped cross section, and a locking plate pivotally coupled to the base. The base includes a bottom wall and two upright sidewalls upwardly extending from two opposite sides of the bottom wall so as to devise a passage through which the ratchet member can pass. On one end of the upright sidewall a retaining recess is formed and a pivot hole is formed on the other end of the upright sidewall. The locking plate is mounted between the upright sidewalls of the base and is formed with a pair of pivotal protrusions for being inserted into the corresponding pivot holes on the upright sidewalls for pivotally coupling the locking plate to the base and, a pair of retaining rods for engagement with the retaining recesses on the upright sidewalls so as to retain the locking plate in position between the upright sidewalls. The locking plate is further coupled with a stopper on the bottom surface thereof so that the ratchet member is prevented from being released from the buckle body when the ratchet body enters and passes through the buckle body and the locking plate is still engaged with the base.

The present invention can be more fully understood from the following detailed description of the preferred embodiment, with reference to the accompanying drawings.

DETAILED DESCRIPTION OF THE PREFERRED EMBODIMENT

Figure 1:
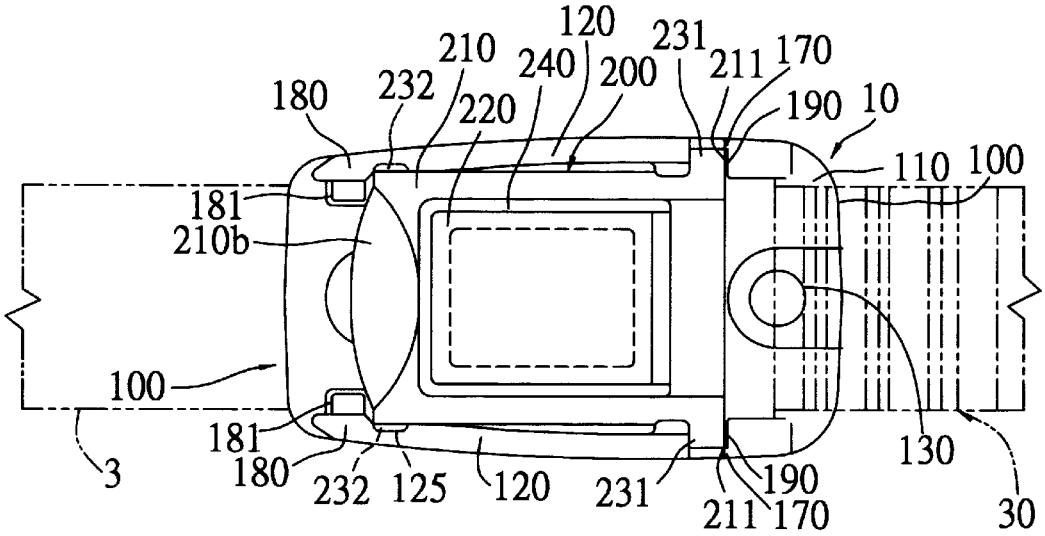
FIG. 1 is a bottom plain view of the buckle body of the buckle device according to the present invention.

Referring to FIGS. 1 to 5, the adjustable buckle device of the present invention is shown comprised of a buckle body 10 fixed to one end of a strap 3 and a ratchet member 30 integral with the other end of the strap for being slidably inserted through the body 10 and locked by the buckle body 10 in position. The ratchet member 30 has continuous teeth formed on the upper surface thereof, and each of the teeth has an upright side 300 and an opposing slanted side 301.

Figure 2:
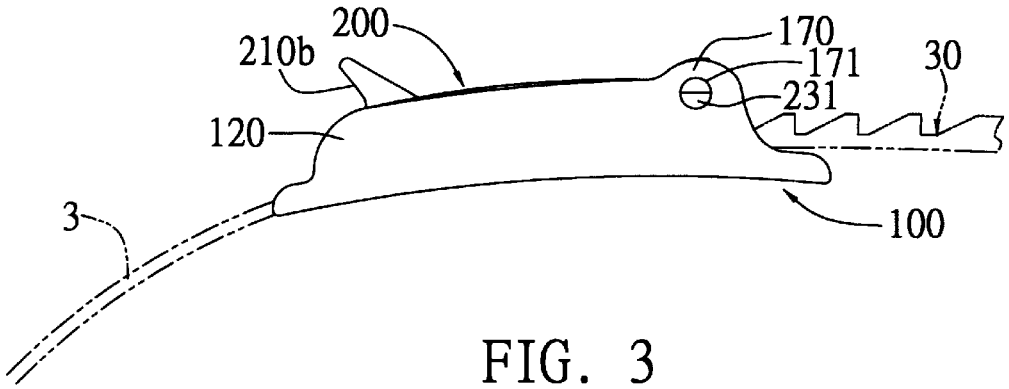
FIG. 2 is a front view of the buckle body of the adjustable buckle device according to the invention.
Figure 3:
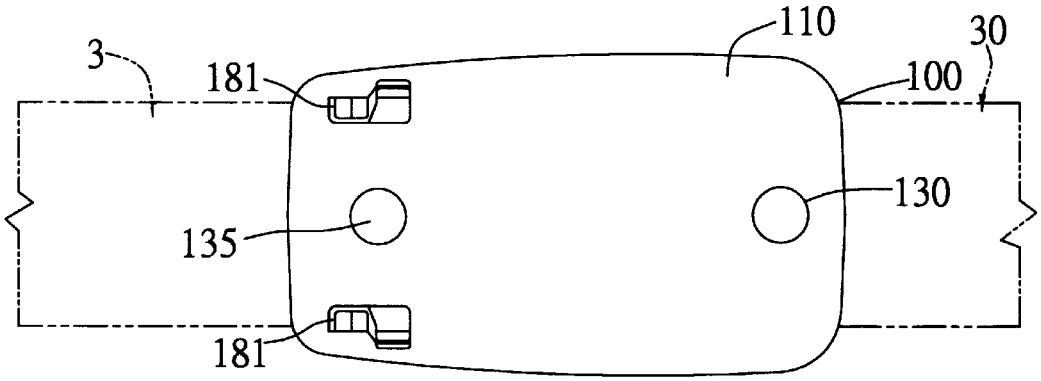
FIG. 3 is a top view of the buckle body of the adjustable buckle device according to the present invention.

As illustrated in FIGS. 1 to 3, the buckle body 10 has a base 100 and a locking plate 200 pivotably coupled to the base 100. The base 100 includes a longitudinally arched bottom wall 110 and two upright sidewalls 120 upwardly extending from two opposite long sides of the bottom wall 110. The bottom wall 110 and the upright sidewalls 120 together define a passage through which the ratchet member 30 passes. The bottom wall 110 is formed with two circular mounting holes 130 and 135 disposed in two opposite ends of the bottom wall 110 for being securely fixed to one end of the strap by conventional means such as a screw. A coupling portion 170 and a retaining portion 180 are respectively provided at two opposite ends of the upright sidewalls 120. The pitch between the two upright sidewalls 120 gradually increases from the end having the retaining portion 180 toward the end having the coupling portion 170, so that the ratchet member 30 can conveniently be inserted into the passage between the upright sidewalls 120 from the ends having the coupling portions 170. The coupling portion 170 is formed with a pivot hole 171 allowing a pivotal protrusion 231 of the locking plate 200 to insert thereinto for the locking plate to pivotally turn about the pivotal protrusion 231 with respect to the base 100.

The retaining portion 180 has a protruding rod 181 at the inner surface thereof, and a retaining recess 125 is formed on the inner surface of the upright sidewalls 120 adjacent to the protruding rod 181. After the ratchet member 30 is inserted into the passage between the upright sidewalls 120 of the base 100, the ratchet member 30 will pass through the space between the bottom wall 110 and the protruding rod 181 of the upright sidewalls 120 to thereby prevent the ratchet member 30 from being upwardly deviated from the passage by the protruding rod 181.

The locking plate 200 is in a rectangular shape and disposed between the two upright sidewalls 120 for being pivotally coupled to the base 100 by inserting the pivotal protrusion 231 into the corresponding pivot hole 171 of the upright sidewall 120. The locking plate 200 is further formed with a pair of retaining rods 232 bilaterally provided at the two sides of the locking plate 200 for engagement with the retaining recesses 125 on the upright sidewalls 120. A substantially U-shaped slot 240 is formed on the locking plate 200. The U-shaped slot 240 is adapted to divide the locking plate 200 into a peripheral frame 210, and a resillient actuating tongue 220. The peripheral frame 210 has one end terminated in a smoothly curved finger strip 210*b*. The finger strip 210*b* curves upwards for the expedience of the user's holding by fingers. Two depressing portions 211 are bilaterally provided at the peripheral frame 210 of the locking plate 200 remote from the finger strip 210*b* and adjacent to the pivot protrusions 231. When the locking plate 200 is upwardly pivotally turned relative to the base 100, the depressing portions 211 will urge against an end portion 190 formed on the end of each of the upright sidewall 120, causing the upright sidewalls 120 on the end of each of the upright sidewall 120, causing the upright sidewalls 120 to be forced to be stretched apart from each other. When the external force exerted on the locking plate 200 is released, the upright sidewalls 120 immediately restore to their normal position due to the elasticity of the upright sidewalls 120, thereby causing the locking plate 200 to be forced back to be received within the base 100.

Two downward flanges (not shown) may be downwardly protruded from the bottom surface of the peripheral frame 210 to allow the ratchet member 30 to pass through the buckle body 10. A stopper 221 is formed integral with and downwardly extending from the bottom surface of the resillient actuating tongue 220. The stopper 221 has a vertical side 221*b* and a slanted side 211*c*.

Figure 4:
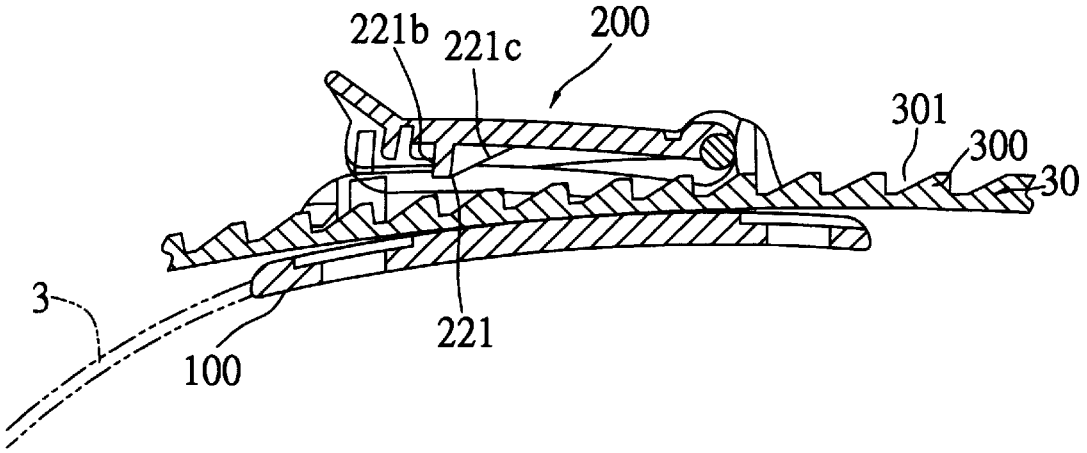
FIG. 4 is a sectional view of the present invention, showing that the ratchet member is inserted through the buckle body.
Figure 5:
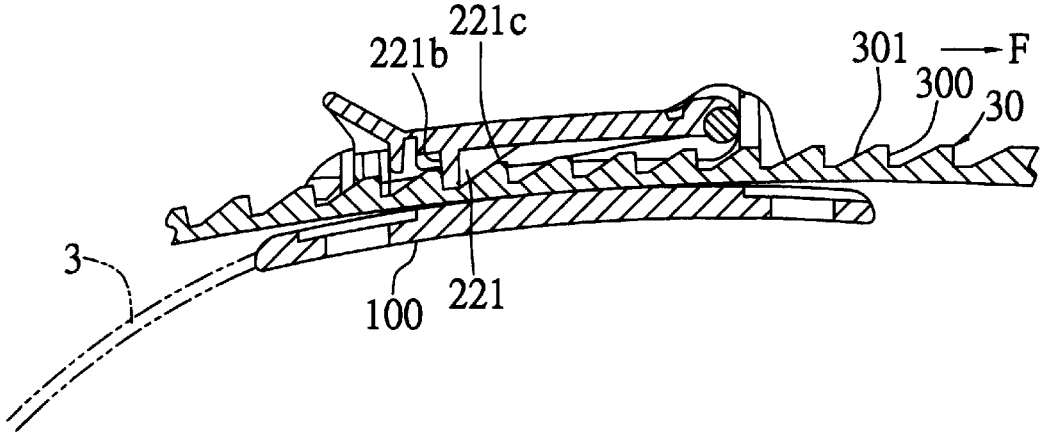
FIG. 5 is a sectional view of the present invention, showing that the ratchet member is securely engaged with the buckle body.

Referring to FIGS. 4 and 5, when passing the ratchet member 30 through the passage of the buckle body 10, the locking plate 200 will remain in position in such a manner that the locking plate 200 is engaged with the base 100 by the engagement of the retaining rods 232 with the retaining recesses 125 as well as by that of the depressing portions 211 with the end portions 190. As the forward movement of the ratchet member 30 allows the slanted side 301 of the tooth to encounter the slanted side 221*c* of the stopper 221, it permits permitting the ratchet member 30 to forwardly move without the prevention of the stopper 221. However, in the cast that the locking plate 200 remains engaged with the base 100, the ratchet member 30 is unable to be pulled backwards as the vertical side 221*b* will block the upright side 300 of the tooth to thereby prevent the ratchet member 30 from releasing from the buckle body 10, as shown in FIG. 5.

When unlocking ratchet member 30 from the buckle body 10, a user simply needs to grasp the finger strip 210*b* of the locking plate 200 to lift up the locking plate 200, causing the stopper 221 to disengage with the tooth of the ratchet member 30, as shown in FIG. 4.

While only one embodiment of the present invention has been shown and described, it will be understood that various modifications and changes could be made thereunto without departing from the spirit and scope of the disclosed invention.

What is claimed is:

1. An adjustable buckle device, comprising:

a buckle body fixed to one end of a strap, the buckle body including a base having a bottom wall and a pair of opposing upwardly extending sidewalls, the sidewalls being each formed with a retaining recess and a pivot hold respectively on two ends thereof;

a locking plate having a pair of opposing pivotal protrusions for inserting into the corresponding pivot hole of the sidewall for pivotally coupling the locking plate to the base, a pair of opposing retaining rods for engagement with the retaining recesses of the sidewalls so as to retain the locking plate in position relative to the base; a stopper integral with a bottom surface of the locking late, the stopper being formed with a vertical side and a slanted side opposing the vertical side; and a ratchet member fixed to the other end of the strap and having a plurality of continuous teeth each being formed with an upright side and slanted side opposing the upright side.

2. The adjustable buckle device of claim 1, wherein a pitch between the sidewalls of the base gradually increases from one end of the sidewall having the retaining recess toward the other end of the sidewall having the pivot hole.

3. The adjustable buckle device of claim 1, wherein the locking plate is formed with a U-shaped slot for dividing the locking plate into a peripheral frame and a resilient actuating tongue connected to the peripheral frame.

4. The adjustable buckle device of claim 3, wherein the stopper is formed on a bottom surface of the resilient actuating tongue.

5. The adjustable buckle device of claim 1, wherein one of the ends of the locking plate terminates in an upwardly curved finger strip.

6. The adjustable buckle device of claim 1, wherein the sidewalls are each formed with an end portion for being urged by a depressing portion formed on the locking plate.

7. The adjustable buckle device of claim 1, wherein the slanted side of the stopper of the buckle body is positioned in a direction opposite to the slanted side of the tooth of the ratchet member.

* * * * *